US007789087B2

(12) United States Patent
Pham et al.

(10) Patent No.: US 7,789,087 B2
(45) Date of Patent: Sep. 7, 2010

(54) TABLETOP CIGARETTE MAKER

(75) Inventors: Xuan Pham, Glen Allen, VA (US); Robert T. Mitten, Glen Allen, VA (US); Linwood H. Carneal, Jr., Richmond, VA (US); William A. Cupp, Aylett, VA (US)

(73) Assignee: Philip Morris USA Inc., Richmond, VA (US)

( * ) Notice: Subject to any disclaimer, the term of this patent is extended or adjusted under 35 U.S.C. 154(b) by 802 days.

(21) Appl. No.: 11/796,296

(22) Filed: Apr. 27, 2007

(65) Prior Publication Data

US 2007/0289601 A1 Dec. 20, 2007

Related U.S. Application Data

(60) Provisional application No. 60/795,874, filed on Apr. 28, 2006.

(51) Int. Cl.
*A24C 5/00* (2006.01)

(52) U.S. Cl. ..... 131/74; 131/70

(58) Field of Classification Search ..... None
See application file for complete search history.

(56) References Cited

U.S. PATENT DOCUMENTS 2,731,971 A 1/1956 Kastner
6,970,731 B1 7/1974 Raddi et al.
6,345,624 B1 2/2002 Kastner et al.
7,565,818 B2 * 7/2009 Thomas et al. ..... 65/74
2002/0185140 A1 12/2002 Hon

FOREIGN PATENT DOCUMENTS

| | | |
|---|---|---|
| DE | 36 05 052 | 8/1987 |
| EP | 0 144 060 | 6/1985 |
| EP | 1 177 731 | 2/2002 |
| WO | WO-2004/047569 | 6/2004 |
| WO | WO-2006/130367 | 12/2006 |

* cited by examiner

*Primary Examiner*—Philip C Tucker
*Assistant Examiner*—Michael J Felton
(74) *Attorney, Agent, or Firm*—Connolly Bove Lodge & Hutz LLP

(57) ABSTRACT

The present invention relates to the cigarette making apparatus 10 which may comprise a housing 12 with mechanical and electrical features. Cigarette apparatus 10 has a solenoid-assisted hopper 14 for accepting loose tobacco 15, a cigarette tube filling cassette 16 with nozzles 30 and a hinged lid 34 for assisting in maintaining cigarette tubes 24 in a predetermined alignment for loading tobacco 15, a filling area 17 with a indexing means for aligning cigarette tubes with a tobacco pushing means inside the apparatus, a cigarette tube loading and tobacco packing means 18 with guide pins 20 for guiding the cassette 16 in engagement with flattened tip pins 22 that compress tobacco 15 into cigarette tubes 24 after tobacco 15 has been inserted, and an electronic control area 26, which may include an electronic display for controlling the cigarette tube filling and packing apparatus.

16 Claims, 9 Drawing Sheets

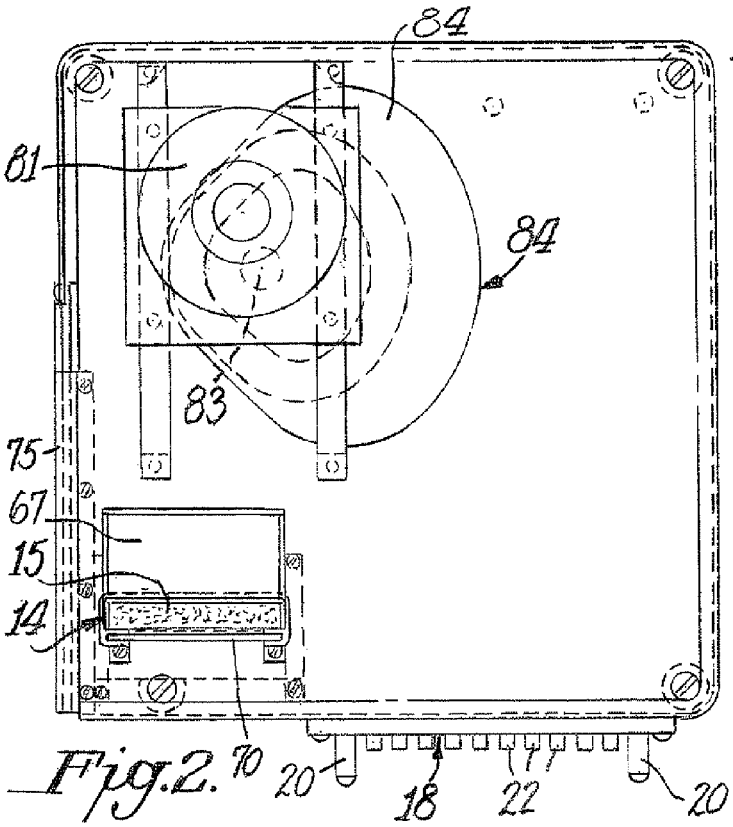
Fig.3.
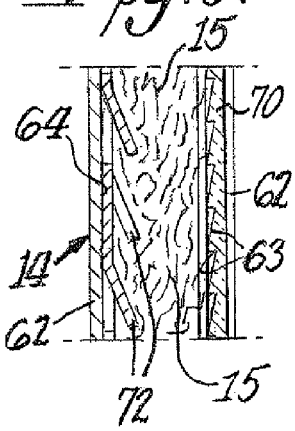
Fig.9.
Fig.2.
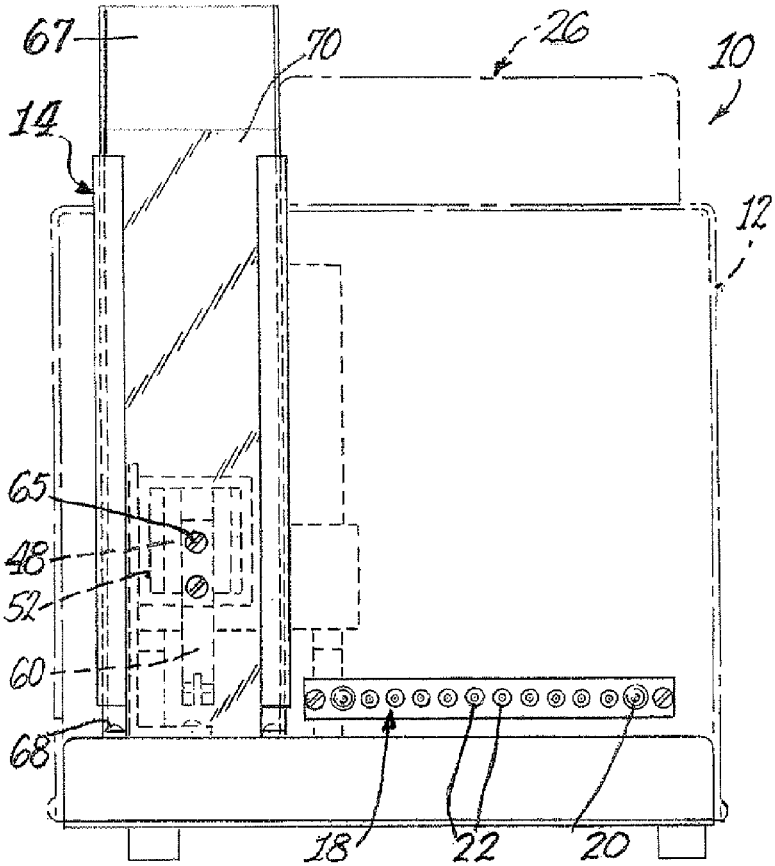
Fig.8.
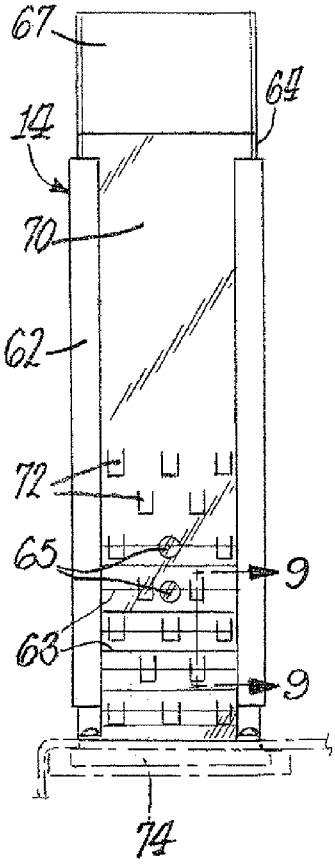

70
64
63
72
65
52
48
62
50
59
60
61
56

TABLETOP CIGARETTE MAKER

CROSS REFERENCE RELATED TO APPLICATION

The present application claims the benefit of provisional application Ser. No. 60/795,874, filed Apr. 28, 2006, for all useful purposes, and the specification and drawings thereof are included herein by reference.

FIELD OF THE INVENTION

The present invention relates to a cigarette making machine that is particularly suited for tabletop use.

BACKGROUND OF THE INVENTION

The prior art provides devices and methods for persons to create their own cigarettes.

U.S. Pat. No. 3,127,900 to Kastner discloses a cigarette making machine that employs a plunger to inject compressed tobacco into a pre-formed cigarette tube. The pre-formed empty cigarette tube is manually held at one end of a nozzle of the cigarette making machine during the injection of the portion of tobacco.

U.S. Pat. No. 6,345,624 to Kastner teaches a compact cigarette making machine for compacting and inserting a quantity of tobacco into a preformed cigarette tube. The tobacco receiving member is slidably retained within a base and movable longitudinally thereon to load tobacco into a cigarette tube secured to a nipple at its forward end. A cover is pivotally secured to the rearward end of the tobacco receiving member and slidable therewith respect to the base. The cover is pivotally movable from an open position to a closed position overlying the tobacco receiving member. The cover is substantially of the same width as the base and has a pair of opposed inner tongues engagable under a respective elongated flange which projects inside the open channel-shaped base from opposed side walls thereof when the tobacco receiving member is retracted rearwardly over the base. Accordingly, the cigarette making machine is very compact in dimension and can be easily carried by a user person.

The prior art fails to disclose a semi-automatic means to combine cigarette components, such as tobacco & a pre-made filter tube, to form multiple cigarettes quickly and of uniform quality.

It is therefore an objective of the invention to provide a convenient way to make and design cigarettes at home or in a retail kiosk or shop.

It is an objective of the invention to provide a device that will allow users to create custom cigarettes. Features of the tobacco, such as the blend, cut, and weight, can be tailored to accommodate users' specific tastes and desire from their cigarettes.

It is also an objective of the invention to provide a device that gives consumers a convenient way to create cigarettes with a controlled and reproducible quality whenever desired.

SUMMARY OF THE INVENTION

To accomplish these and other objectives, this invention provides a cigarette making apparatus that may generally may comprise a housing, a solenoid-assisted hopper for accepting loose tobacco, a cigarette tube filling cassette with nozzles and a hinged lid for assisting in maintaining cigarette tubes in a predetermined alignment for loading tobacco, a filling area with an indexing means for aligning cigarette tubes with a tobacco pushing means inside the apparatus, a cigarette tube loading and tobacco packing means with guide pins for guiding the cassette in engagement with flatted tip pins that compress tobacco into cigarette tubes after tobacco has been inserted, and an electronic control area, which may include an electronic display for controlling the cigarette tube filling and packing apparatus.

In accordance with the present invention a cigarette can be custom made by an individual. The size and user-friendly designs make the device fit perfectly for tabletop environment at home/kiosk.

The device provides a better tobacco flow in the hopper with shaking-hopper design, fish-scale vibrator and see-through, ribbed sliding door. The device provides a better loading/inserting tobacco with the waved profile spoon. This construction and design provide consistent weights and volumes of tobacco.

An advantage of the invention is that consumers can purchase filter tubes and tobacco in bulk and store the items in airtight containers until a cigarette is desired. Thus, they may save money by buying in bulk and by reducing or eliminating trips to a store to purchase packs of cigarettes.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which:

FIG. 2 is a front elevational view of the cigarette apparatus of FIG. 1;

FIG. 3 is a top plan view of the base of the cigarette apparatus of FIG. 1 with the housing removed;

FIG. 8 shows hopper tobacco compacting fish scales and ribs; and

FIG. 9 is a cross sectional view in elevation taken along line 9-9 in FIG. 8;

DETAILED DESCRIPTION OF A PREFERRED EMBODIMENT

Figure 1:
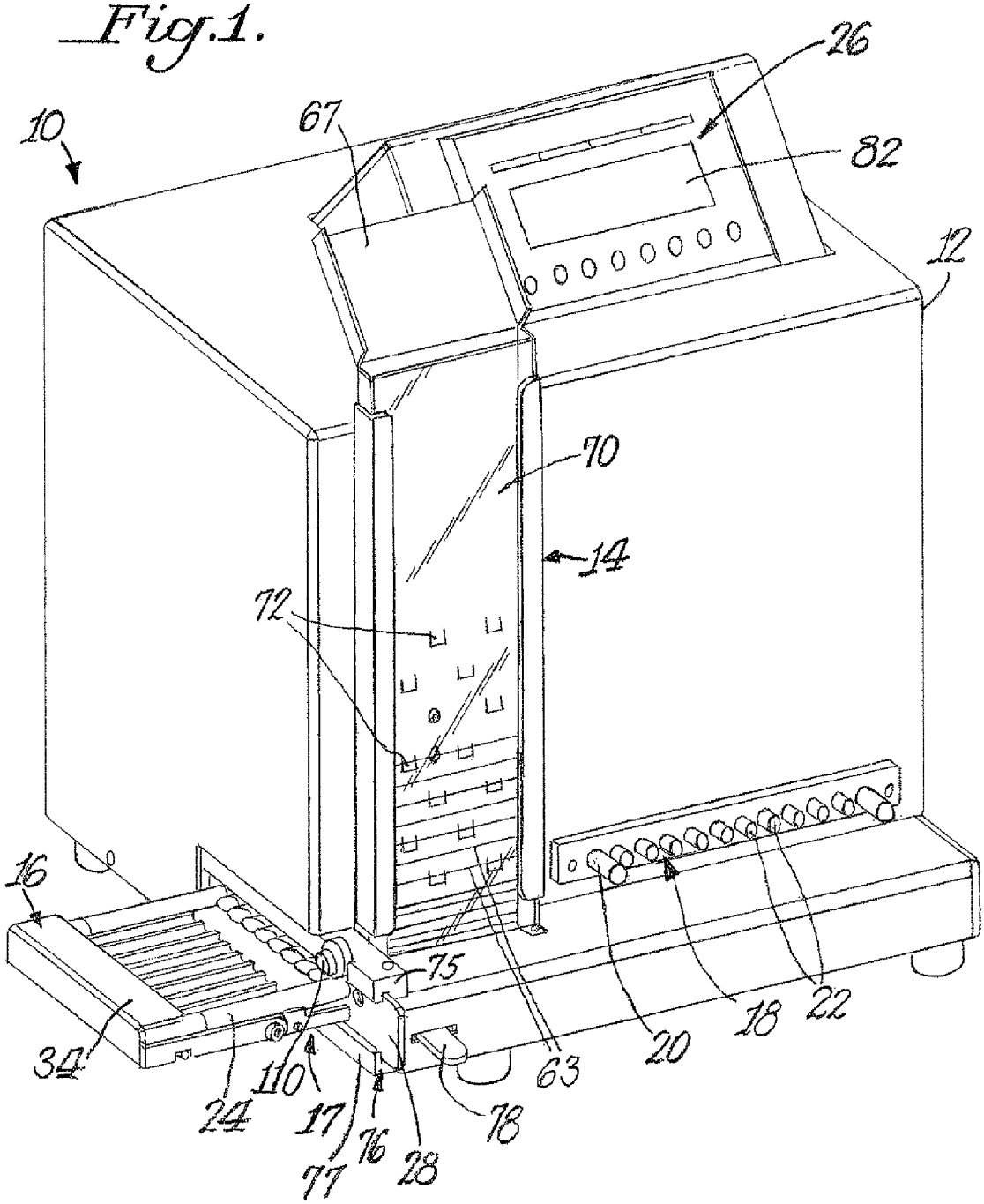
FIG. 1 is a perspective view of a cigarette apparatus according to one embodiment of the present invention.

Referring with more particularity to the drawings, FIGS. 1-5 generally illustrate a cigarette making apparatus according to one embodiment of the present invention. The apparatus may be on the order of the size of a consumer coffee maker (e.g. 20 cm×20 cm×23 cm) making it ideal for tabletop use, such as by a consumer or by a business owner with a limited amount of space. The apparatus allows users to create a finished cigarette by combining a cigarette tube with compacted tobacco 15.

As shown in FIGS. 1 through 5, the cigarette making apparatus 10 of the present in invention generally may comprise a housing 12 with mechanical and electrical features. Cigarette apparatus 10 has a solenoid-assisted hopper 14 for accepting loose tobacco 15, a cigarette tube filling cassette 16 with nozzles 30 and a hinged lid 34 for assisting in maintaining cigarette tubes 24 in a predetermined alignment for loading tobacco 15, a filling area 17 with a indexing means for aligning cigarette tubes with a tobacco pushing means inside the apparatus, a cigarette tube loading and tobacco packing means 18 with guide pins 20 for guiding the cassette 16 in engagement with flatted tip pins 22 that compress tobacco 15 into cigarette tubes 24 after tobacco 15 has been inserted, and an electronic control area 26, which may include an electronic display for controlling the cigarette tube filling and packing apparatus. The apparatus will be described, followed by a description of a method for operating the apparatus.

Figure 10:
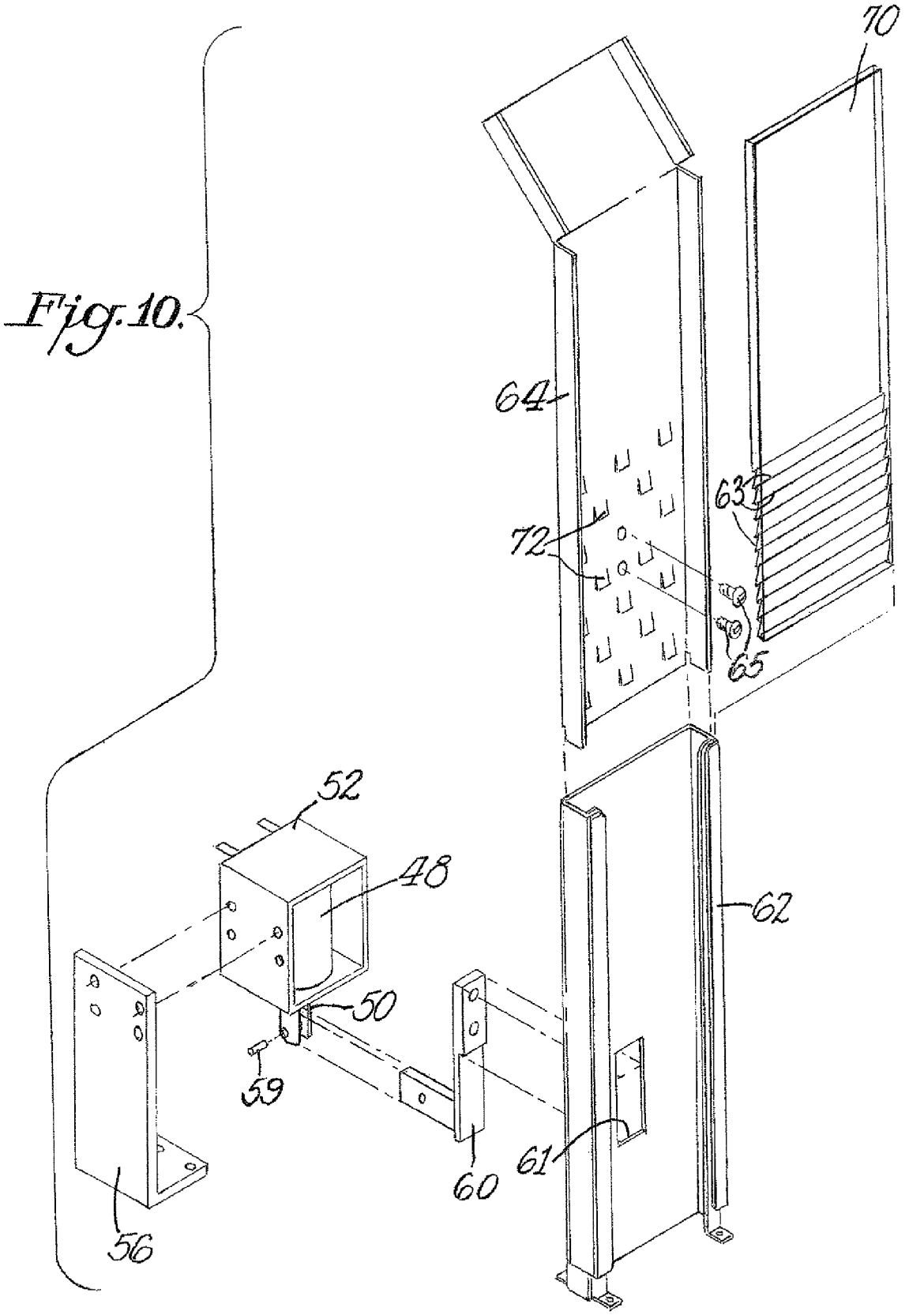
FIG. 10 is an exploded view of the hopper and solenoid mechanism shown in FIGS. 6 and 7.

As shown in FIGS. 2 through 9, cigarette apparatus 10 may have a hopper 14 with a solenoid actuated shaker 64 or other means to assist in compacting and loading of tobacco 15 into the tobacco loading area 74. As more particularly shown in FIGS. 5, 6, 7, and 10, hopper 14 may be connected to a solenoid 48, which drives piston 50. The solenoid 48 may be located within a housing 52 that is connected via connection means, such as screws 54, to a generally L-shaped bracket 56. The bracket 56 may be secured to the cigarette apparatus 10 by securing means, such as bolts 58. As can be observed with regard to FIGS. 5 and 10, piston 50 is connected to a bracket 60 with a pin 59 or other suitable means.

Bracket 60 passes through an opening 61 in a hopper main body 62 and is connected to shaker 64 via bolts 65 or other suitable means.

Figure 6:
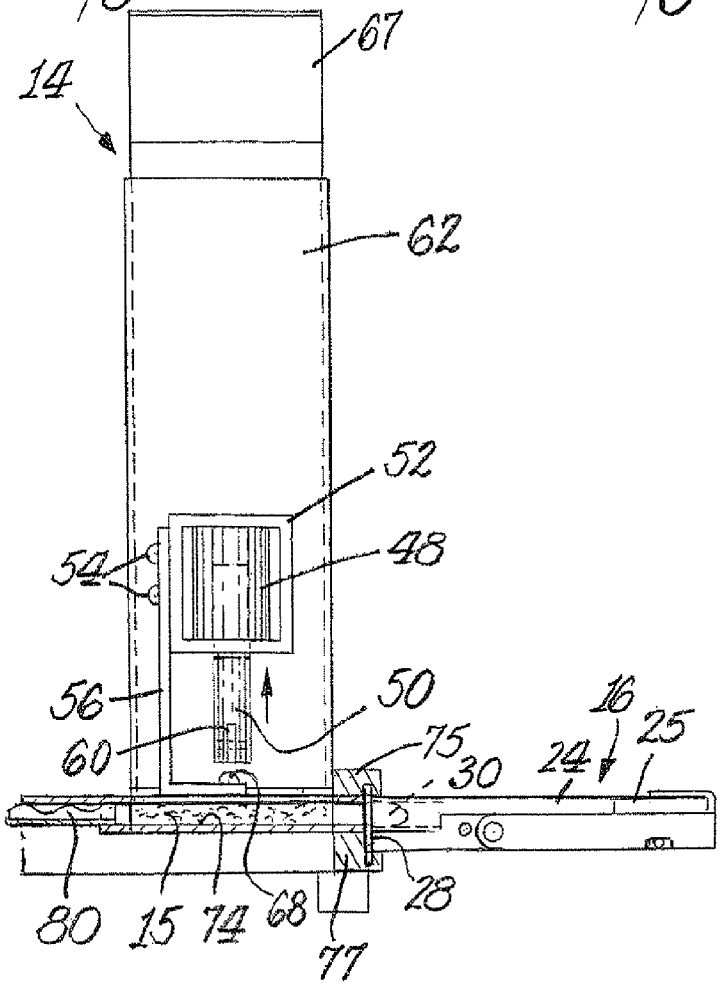
FIG. 6 is a rear elevational view of the hopper and solenoid mechanism in the cigarette apparatus of FIG. 1.
Figure 7:
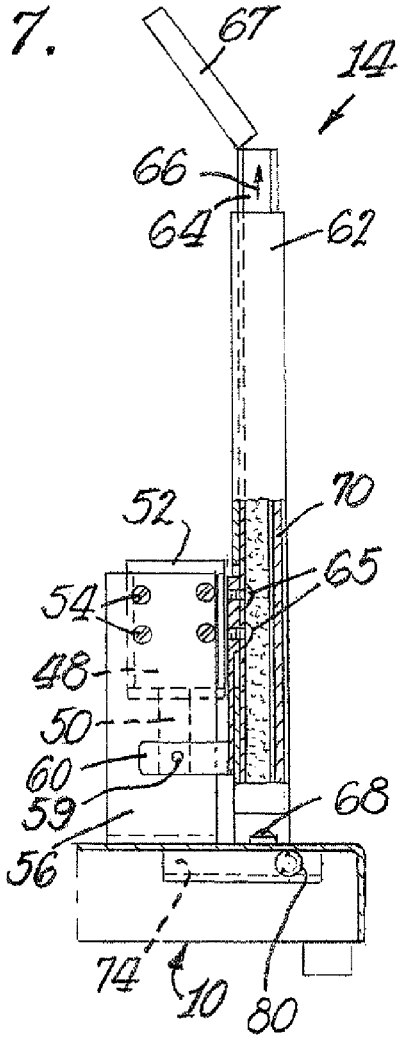
FIG. 7 is a side view of the hopper and solenoid mechanism in the cigarette apparatus of FIG. 1.

As shown in FIG. 7, shaker 64 reciprocates to "shake" the tobacco 15 into loading area 74, shown in FIG. 6. As the piston 50 moves upwards, the shaker 64 is moved upward as designated by arrow 66. The hopper main body 62, which has a generally c-shaped cross-section and at least partially surrounds shaker 64, remains relatively stationary with respect to the apparatus 10 because of its connection to apparatus 10 by a bolt 68 or other suitable means. The shaker 64 may additionally have tobacco loading guide 67 that directs tobacco dropped onto it into the hopper 14.

The hopper 14 may also be provided with a sliding front cover or door 70 with ribs 63. Door 70 may be transparent and may remain relatively stationary when shaker 64 is reciprocating.

As shown in FIG. 8, compactor 64 may be provided with fish-scales 72. As shown in FIG. 9, a view taken along line 9-9 of FIG. 8, the ribbed door 70 and fish-scales 72, protrusions extending outwardly and downwardly from shaker 64, to enhance and control the flow of cut tobacco 15 into the loading chamber 74 at the bottom of the hopper 14. The tobacco loading process will be described in further detail below.

Turning to FIGS. 11-16, the apparatus is also provided with a cigarette tube holding cassette 16, which may be designed to engage a cigarette tobacco-packing means 18 located on the front of the apparatus 10.

Figure 11:
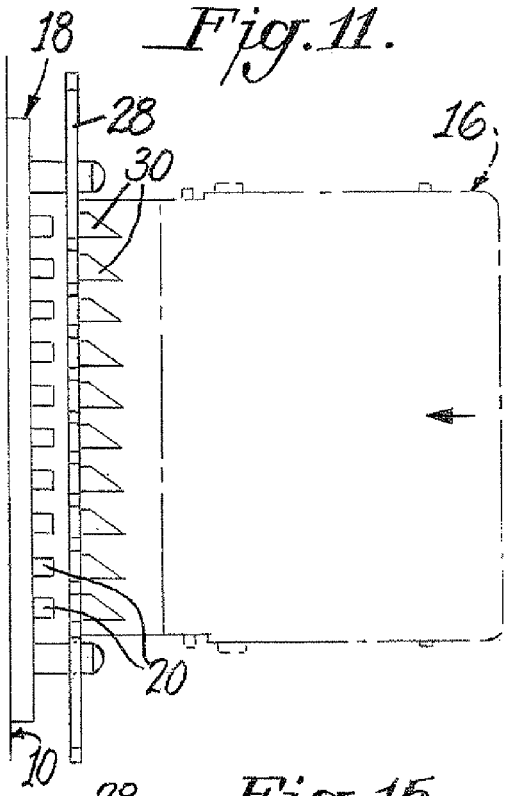
FIG. 11 is a top plan view of an unloaded tube carriage cassette as it is initially placed on flatted tip pins of the cigarette apparatus of FIG. 1.
Figure 12:
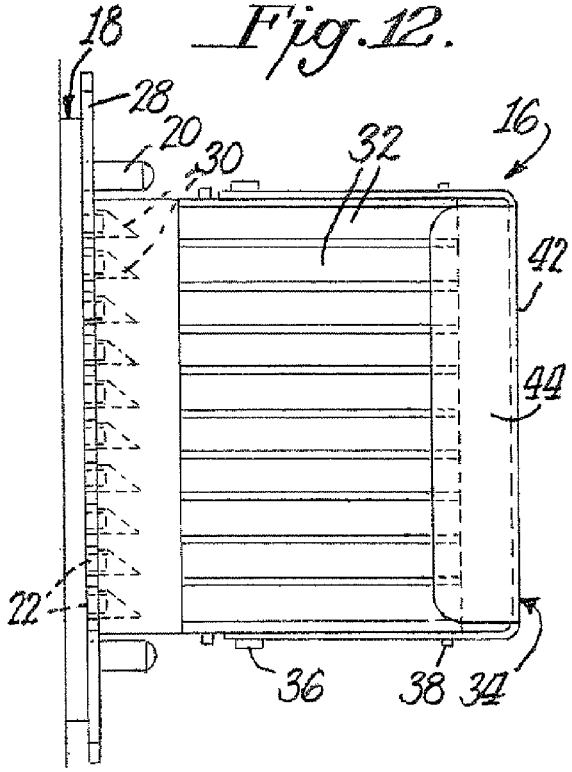
FIG. 12 is a top plan view of an unloaded tube carriage cassette that is fully loaded on flatted tip pins of the cigarette apparatus of FIG. 1.
Figure 15:
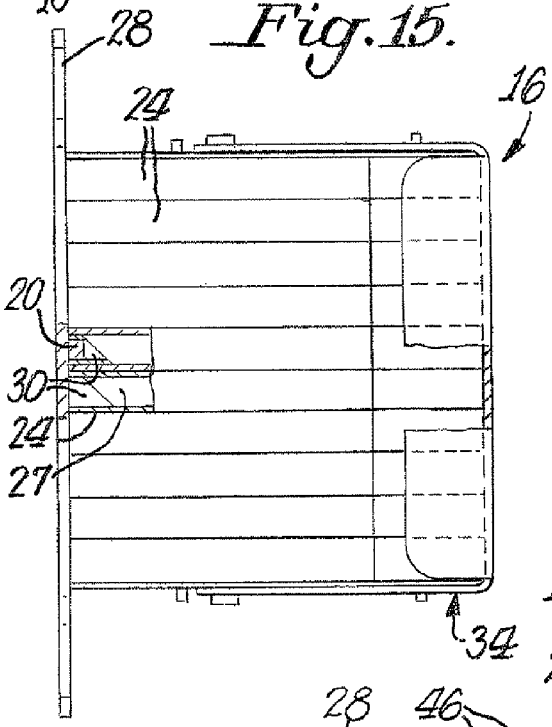
FIG. 15 is a top plan view of a tube carriage cassette that is fully loaded on the cassette with filter tubes engaged with flatted tip pins of the cigarette apparatus of FIG. 1 with a partial breakaway to show filter tubes engaged with tapered positioning nozzles and flatted tip pins.

FIG. 11 shows the cassette as it is initially engaged with guide pins 20 of the cigarette tube loading and packing means 18. Guide pins 20 are engaged with a support plate 28 of cassette 16 to align flattened tip pins 22 with positioning nozzles 30, which may be tapered. Nozzles 30 may be designed to fit within a cigarette tube 24 so that the cigarette tube 24 will remain in an open position when it is loaded onto the filling indexer as described in more detail below.

Figure 13:
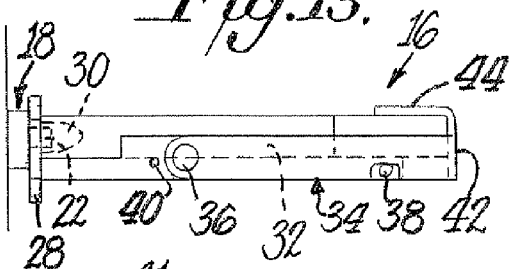
FIG. 13 is a left side elevational view the cassette shown in FIG. 12 with its hinged lid in the closed position.
Figure 14:
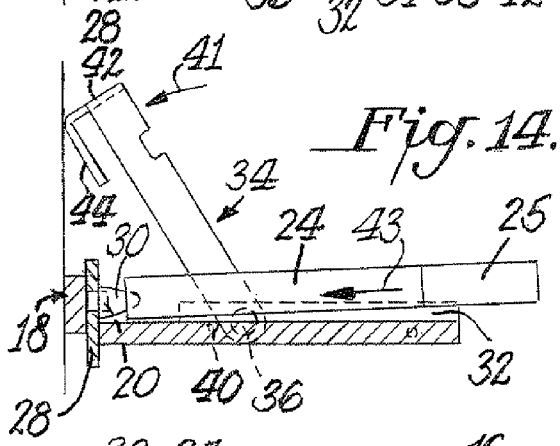
FIG. 14 is a left side elevational view the cassette shown in FIG. 12 with the hinged lid rotated upwards and cigarette tube being loaded into engagement with tapered positioning nozzles.

FIGS. 12-16 illustrate the cassette 16 as it is fully loaded onto the cigarette tube loading means 18. In this position, flattened tip pins 22 may fit within nozzles 30. Cassette 16 is also provided with filter tube cradles 32, which may be semi-circular-shaped, to accept a cigarette tube 24. Cassette 16 has a hinged lid 34, which may be configured to have a rear retaining portion 42 and top retaining portion 44 to maintain cigarette tubes 24 in a relatively fixed position during the tobacco loading process. The lid 34 may pivot around a pivot pin 36. When the lid 34 is in a closed position it may rest on stop pin 38 as shown in FIG. 13. In the rotated or open position lid 34 may rest on stop pin 40 as shown in FIG. 14.

Each cigarette tube 24 may be loaded onto cassette 16 as shown in FIG. 14. To load one or more cigarette tubes 24, the lid 34 may be rotated into the open position as illustrated by arrow 41. The cigarette tube 24 may be slid in the direction of arrow 43 or placed into position within filter tube cradle 32 so that it is engaged and overlapping nozzle 30. The lid 34 may then be rotated back into the closed position. Cassette 16 may be designed to accommodate, for example, ten or twenty cigarette tubes 24. For purposes of illustration, a 10 cigarette tube version is shown, for example, in FIG. 15. The apparatus 10 may be designed such that the cassette 16 may be provided with less than a full load of cigarette tubes 24, depending on how many filled cigarettes the user wishes to create.

Figure 16:
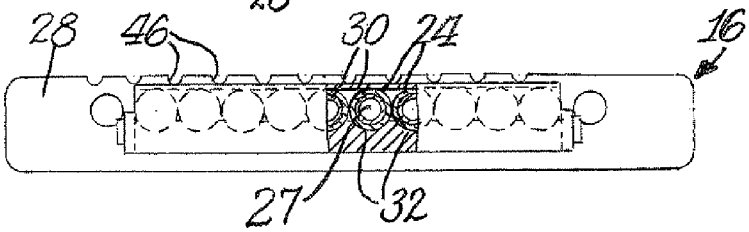
FIG. 16 shows a front elevational view of the tube carriage cassette with a partial breakaway to show filter tubes engaged with tapered positioning nozzles.

FIG. 16 shows a front elevational view of the cassette 16. The cassette 16 may have indexing slots 46 that are designed to engage with a indexing wheel 110 to allow the selectable alignment of each nozzle 30 with a filling means in the filling area as will be described in more detail below.

Figure 25:
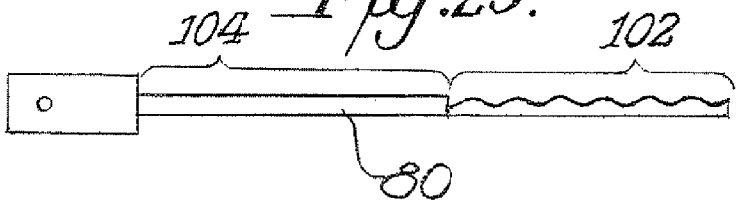
FIG. 25 is a top elevational view of the tobacco pushing means.
Figure 17:
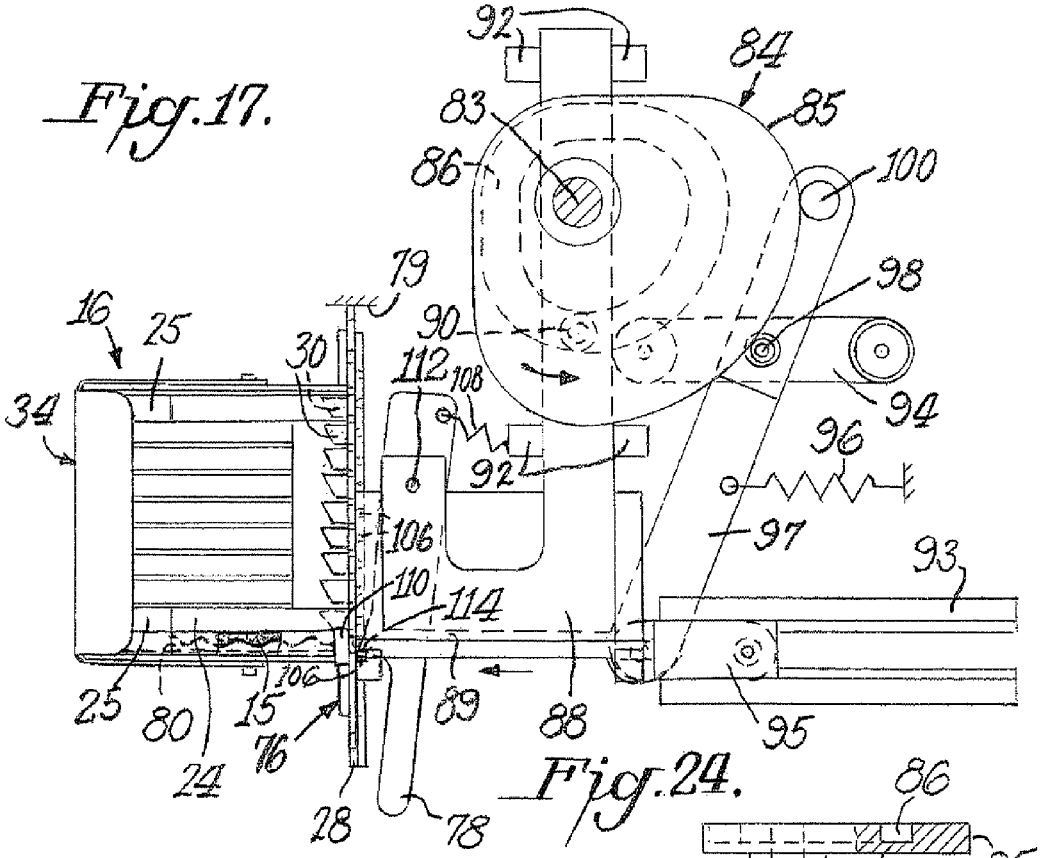
FIG. 17 is a top plan view showing the drive cam with an inner cam maintaining the compacting means proximate to the pushing means while an outer cam directs the pushing spoon to push tobacco compacted by the compacting means into a cigarette tube

Referring back to FIG. 1, the cigarette tube filling area 17 may be provided on the side of the apparatus 10 and may have a means, such as a track 76 comprising an upper guide track 75 and a lower guide track 77, for accepting the support plate 28 of the cassette 16. The cassette 16 may also be engaged with an indexer 78 and indexing wheel 110 such that the nozzles 30 on the cassette 16 can be aligned with spoon 80, which extends from apparatus 10 during the tobacco loading process, as shown in FIGS. 6, 7 and 17. The spoon 80 is shown in more detail in FIG. 25 and may have a waved profile to improve pushing efficiency.

Referring again to FIG. 1, an electronic control box 26 may be provided on the top of the apparatus 10 and may comprise a display 82. The control box 26 may permit the customer to control apparatus parameters such as the number of times the hopper 14 shakes for each cigarette 24, and the quantity of cigarettes to be loaded. The display may allow a user to view the parameters programmed and the overall status of the operation.

The method of operating of the apparatus and the manner in which the apparatus loads tobacco into cigarette tubes will now be described in more detail.

First, cigarette tubes 24 are loaded onto the cassette 16. The cigarette tubes 24 may be comprised of filters 25, such as cellulose acetate (CA) tow plugs, and paper tubes 27, requiring only tobacco to form a finished cigarette. The cigarette tubes 24 are placed in the grooves and overlap and surround the nozzles 30 as previously described with reference to FIGS. 13-16. The nozzles 30 ensure that the cigarette tubes 24 remain open during the filling process. The hinged lid 34 maintains the cigarette in engagement with the cassette tube and also retains the cigarettes in a relatively fixed position during the packing process. For convenience, the user may load cigarette tubes 24 onto cassette 16 while the cassette 16 is engaged with the flatted tip portions 22 of the loading and packing means 18.

After the cigarette tubes are loaded onto the cassette 16, the cassette 16 may be engaged with an indexer in the tobacco filling area 17 by loading the support wall 28 onto the upper and lower guide tracks 76 and 77. To fully load the cassette 16 onto the tracks, a user may move an indexer 78, which extends outwardly from the apparatus 10, in a direction away from tracks 76 and 77 to move the indexer 78 into a disengaged position. The cassette 16 is pushed along the tracks 76 and 77 until it hits a stop point 79, shown schematically in FIG. 17. Once the cassette is fully loaded on tracks 76 and 77 to stop point 79, the indexer 78 is released to engage the indexer 78 with the cassette 16.

A user may insert a predetermined amount of tobacco based on the number of cigarettes the user desires to make. The hopper door 70 may be removable for cleaning, but preferably is inserted during operation to guide tobacco into the loading chamber 74.

Once the tobacco 15 is loaded into the hopper 14, an electronic control, or computer, 26 may be programmed to control a number of aspects of the process. For example, a user may program the number of cigarette tubes 24 loaded on the cassette and the number of "shakes" or vibrations that the hopper 14 undergoes. Of course, the amount of tobacco 15 metered by the hopper 14 may also be altered by the user by changing the size of cut tobacco 15. The computer 26 may be any conventional computer capable of being programmed to control a process.

Programming the computer to "shake" the hopper 14, i.e. move the solenoid piston 50 up and down, a fewer number of times may create a more loosely filled cigarette. Programming a higher number of "shakes" will compact the tobacco into loading chamber 74 to form a more densely packed cigarette.

With computer 26 programmed, the hopper 14 loaded with tobacco, and the cassette 16 loaded with one or more cigarette tubes 24, the program may then be run and the machine-assisted loading of the cigarette tubes 24 may be commenced. The machine-assisted loading sequence will now be described in more detail with reference to FIGS. 6, 7, and 17-24.

When the process begins, the hopper "shakes" tobacco 15 into the loading chamber 74 based on the number of times programmed by the user. As the shaker 64 moves upward, shown in FIGS. 6 and 7, fish scales 72, shown also in FIG. 9, slide along the loose tobacco 15; the sloped upper side of the fish scales 72, generally do not grab the loose tobacco on the upward ascent. However, as the shaker 64 descends, the undersides of fish scales 72 grab the tobacco and force it toward and into loading chamber 74.

Figure 5:
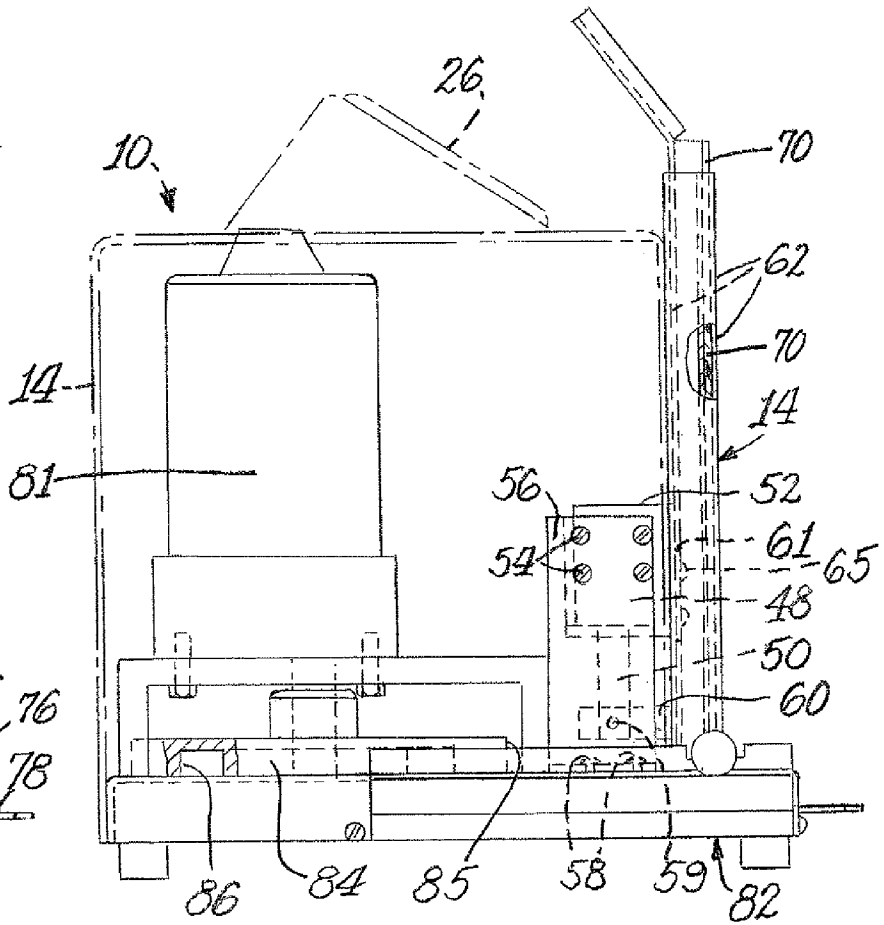
FIG. 5 is a left side elevational view of the cigarette apparatus of FIG. 1 showing interior components of this invention with the outer housing components shown in phantom.
Figure 4:
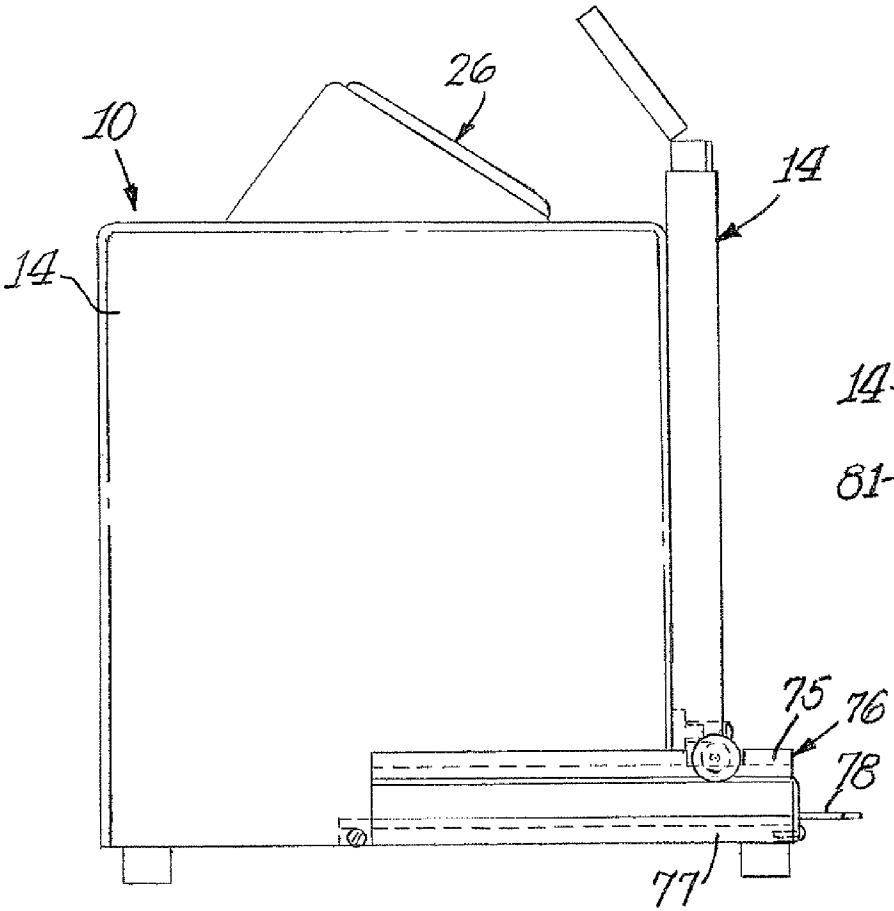
FIG. 4 is a left side elevational view of the cigarette apparatus of FIG. 1.

After tobacco is loaded into the loading chamber 74, a loading mechanism 82, illustrated in FIG. 5 for orientation, loads the compacted tobacco 15 into the cigarette tubes 24. The loading mechanism 82 is driven by a motor 81 that turns a driveshaft 83 and double action cam 84, to drive a tobacco compactor 88 and a tobacco pushing spoon 80. The tobacco loading process will now be described in greater detail with reference to FIGS. 17-23.

As shown in FIG. 17, the loading mechanism 82 is driven by a double action cam 84 that has a track 86. The double action cam 84 is so called because it drives two mechanisms: compactor 88 and pushing spoon 80. As the cam 84 rotates, a compactor cam roller 90 is guided along the track 86, while pushing spoon roller 100 is guided along the outer edge 85. The compactor cam roller 90 may be 90° from pushing spoon cam roller 100 relative to the axis of driveshaft 83.

Compactor guides 92 limit the motion of compactor 88 to a single line of movement, but allow it to reciprocate relatively freely back and forth along that line. For example, the compactor 88 is moved in a forward position in FIG. 17 and in a recessed position in FIG. 20.

Figure 19:
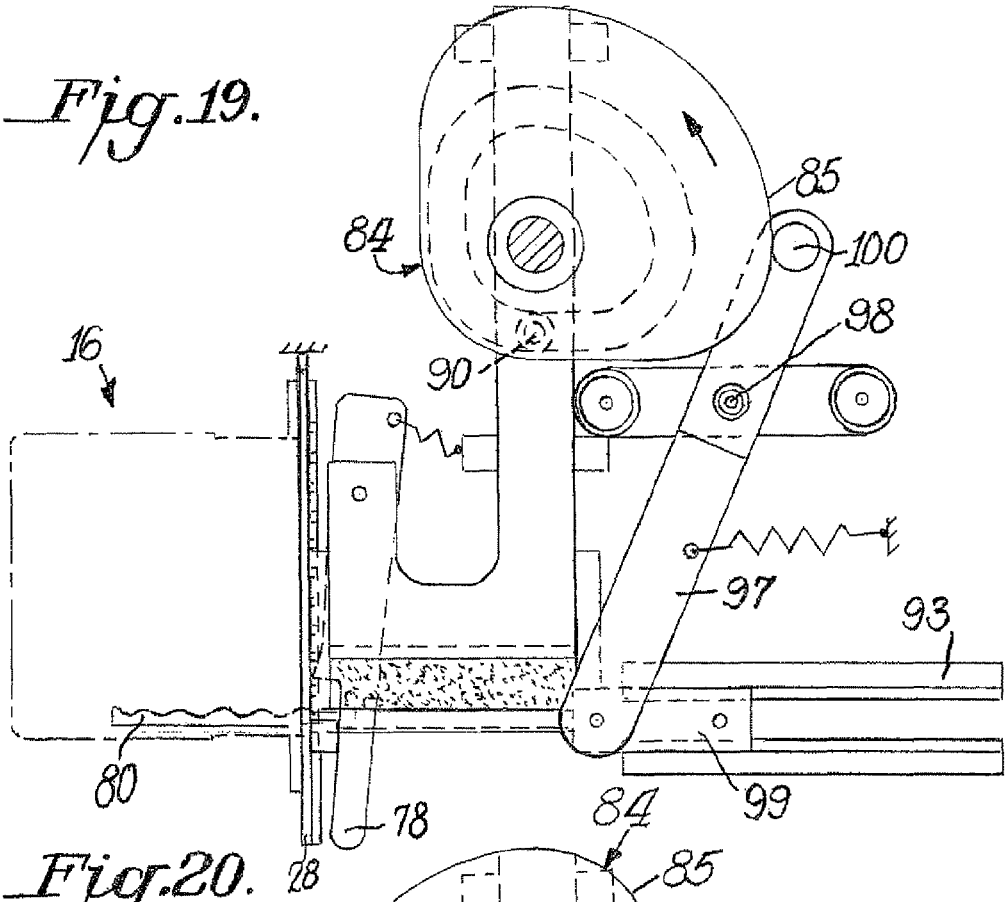
FIG. 19 is a top plan view showing the drive cam with an inner cam directing the compacting means proximate to the pushing means while an outer cam directs the pushing spoon to push tobacco compacted by the compacting means into a cigarette tube.
Figure 20:
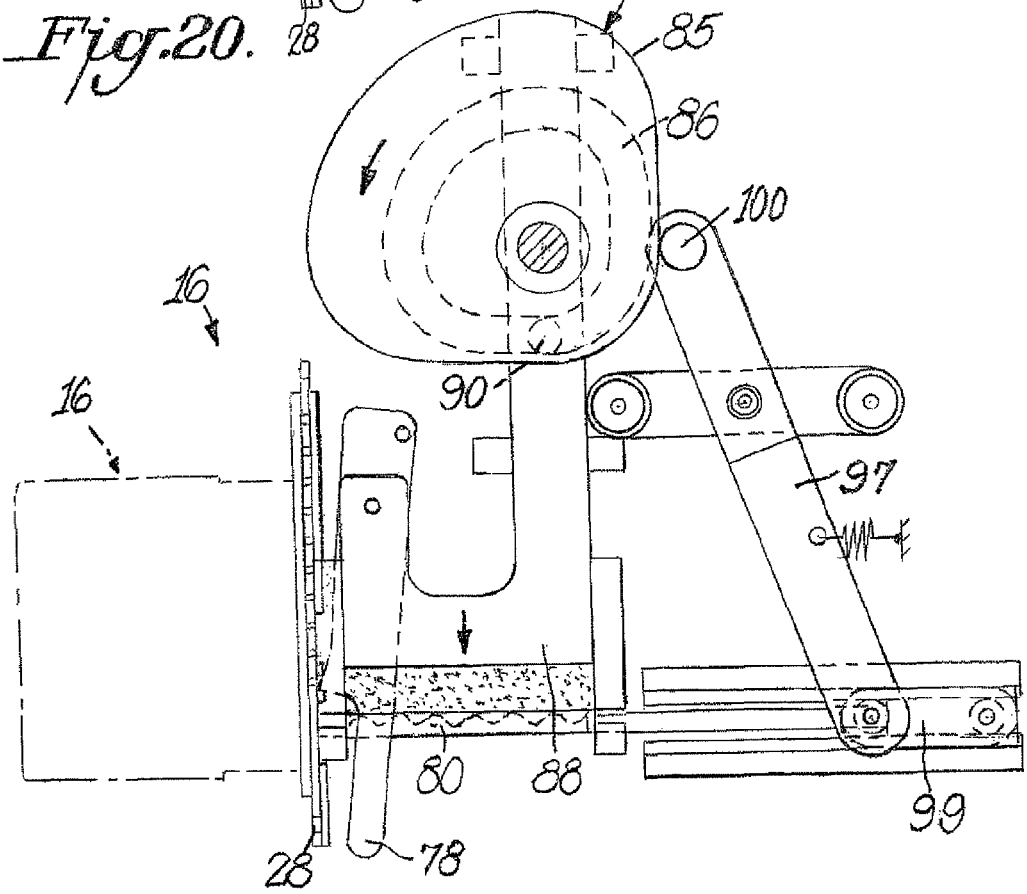
FIG. 20 is a top plan view showing the drive cam with an inner cam directing the compacting toward the pushing spoon and an outer cam directing a spring loaded lever means so that the pushing means is in a position to accept tobacco from the hopper.

FIGS. 17, 19, 20 and 21 show the compactor 88 and spoon 80 in several positions throughout the process. The cam 84 is rotated counterclockwise 90° in each figure. The sequence for loading the cigarette tubes may begin with the compactor 88 and spoon 80 recessed, as shown in FIG. 20, to allow tobacco 15 to enter the loading area 74.

Figure 26:
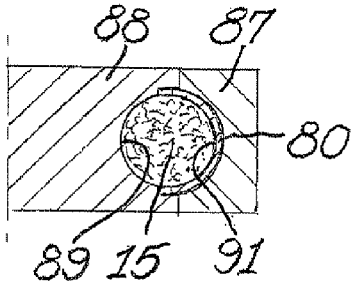
FIG. 26 is a fragmental cross-sectional view taken along line 26-26 of FIG. 21 and shows the compactor and the pushing spoon in a spoon guide with a load of tobacco.

As the process commences, the cam 84 moves in a counter clockwise direction, which advances the compactor 88 forward and compresses tobacco 15. FIG. 17 shows the compactor advanced forward toward spoon 80 and spoon 80 advanced outward from apparatus 10 to insert tobacco into tobacco tube 24. Spoon 80 and compressor 88 may have c-shaped cross-sections shown by lead lines 91 and 89 respectively. The concave c-shapes of the spoon 80 and compressor 88 form a cavity, shown in FIG. 26 in which tobacco 15 can be compacted.

Figure 24:
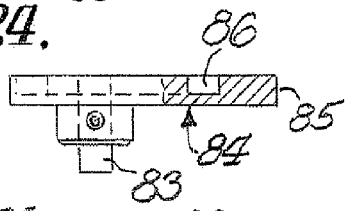
FIG. 24 is a side elevational view of the drive cam according to one embodiment of the present invention.

FIG. 24 shows spoon 80 in more detail. Spoon 80 has a hollow c-shaped portion 102, which may have a waved profile, and a solid portion 104 for pushing tobacco from the loading area 74 into cigarette tube 24.

The movement of spoon 80 is based on the pivoting motion of slide plate 90. More particularly, spoon 80 is attached to slide plate 90 that is attached to a pivoting arm 97, which pivots around a fixed support 94 at point 98. Arm 92 is biased by a spring 96, which forces cam roller 100 to contact the outside edge 85 of cam 84. Thus, as cam 84 rotates around drive shaft 83, the end of member 97 connected to slide plate 90 moves in a radial fashion about point 98. The slide plate 90 translates that radial motion into linear motion for spoon 80, which reciprocates along pushing spoon guide track 93. Slide plate 90 is connected to spoon 80 by a pin 87. A spacer 95 maintains the separation distance between the slide plate 90 below pushing spoon guide track 93 and spoon 80 above pushing spoon guide track 93. The back and forth linear motion advances spoon 80 into cigarette tube 24, as shown in FIG. 17, and then retracts spoon 80 out of cigarette tube 24, as shown in FIG. 20.

FIG. 17 shows the loading of tobacco 15 into the first cigarette tube 24. Cam 84 has rotated about the driveshaft 83 in a counter-clockwise direction such that compactor 88 has compressed the tobacco between the c-shaped edge 89 of the compactor and the c-shaped edge 91 of the pushing spoon 80 and the spoon has advanced forward to push the tobacco into the first cigarette tube 24.

When the cassette is initially loaded, support wall 28 abuts stopping means 79. However, at the point in the process shown in FIG. 17, support wall 28 no longer abuts stopping means 79 because the indexer 78, which is engaged with indexing pin 106, has pushed the indexing pin 106 and the whole cassette 16 forward to align the first cigarette tube 24 on the cassette 16 with spoon 80.

Figure 18:
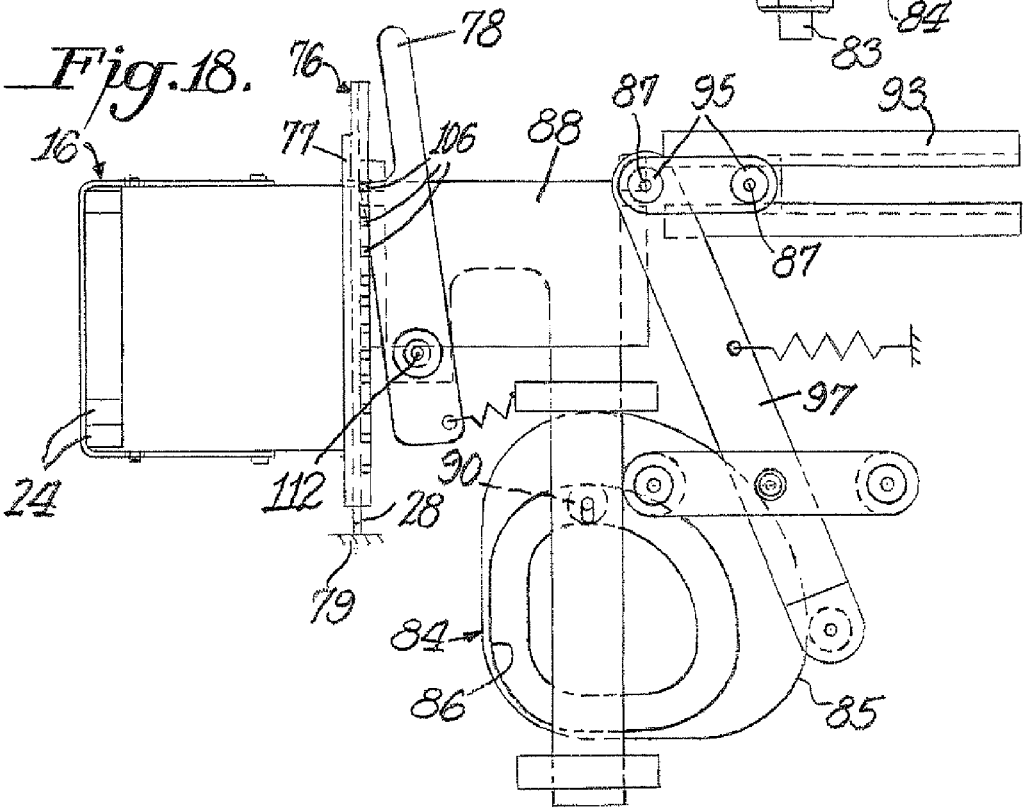
FIG. 18 is a bottom plan view of FIG. 17.
Figure 22:
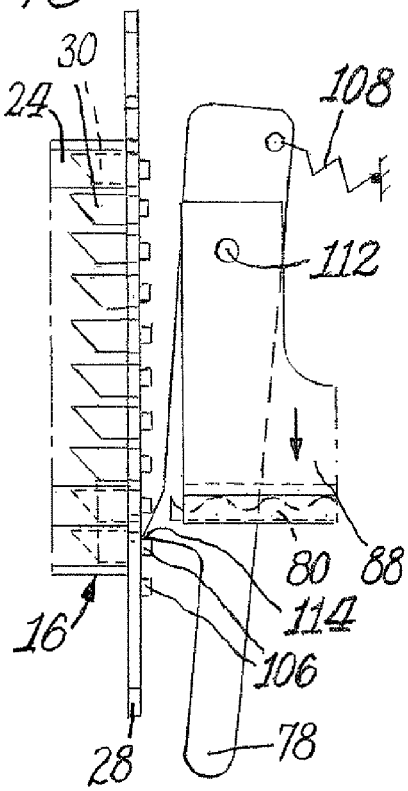
FIG. 22 is a an enlarged, top plan view of the indexer shown in FIG. 21.
Figure 23:
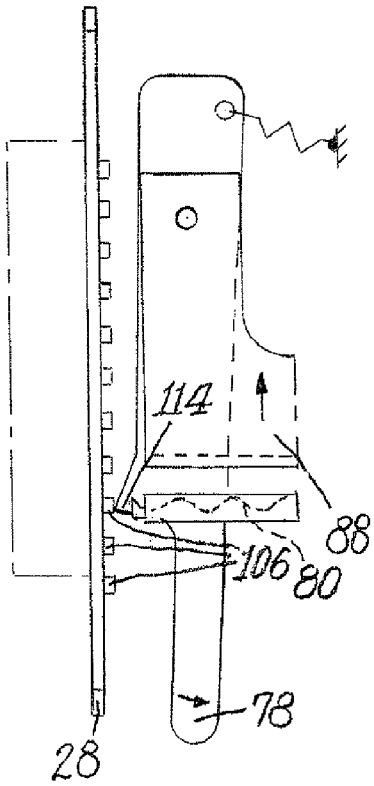
FIG. 23 is a an enlarged, top plan view showing the indexer of FIG. 22 as the cam rotates and retracts the compactor.

The interaction of the indexer 78 with the cassette 16 will now be described with reference to FIGS. 22 and 23. The indexer 78 is maintained in engagement with cassette 16 by a spring 108, which is biased to rotate the indexer 78 around pin 112 and urge the pawl 114 of the indexer 78 against cassette 16. FIG. 18 shows a bottom plan view of FIG. 17 and illustrates the relationship between cassette 16, indexer 78, and compactor 88. The indexer 78 may engage indexing pins 106 that extend from the support wall 28 of the cassette 16. As the compactor is recessed away from the spoon 80, pawl 114 travels over and behind the next indexing pin 106. When the compactor travels back toward the spoon 80, pawl 114 catches indexing pin 106 and urges it forward. An indexing wheel 116, which rotates about an axle 118, sets nozzle 30 ensures that the nozzle is aligned with the spoon 80 as the indexer 78 advances the cassette 16.

FIG. 19 shows cam 84 rotated 90° from its position shown in FIG. 17. Spoon 80 has fully extended to insert tobacco 15 into cigarette 24. The compactor 88 is recessed. As the cam 84 moved counterclockwise into the position shown in FIG. 19, the compactor recessed away from spoon 80 and indexer 78 traveled over indexing pin 106. As the cam 84 continues to move counterclockwise from the position shown in FIG. 19, spoon 80 will recess into apparatus 10.

FIG. 20 shows cam 84 rotated 90° from the position shown in FIG. 19. At this point, cam 84 has fully recessed into apparatus 10 and compactor 88 remains recessed to permit tobacco 15 to enter loading chamber 74 from the hopper 14.

Figure 21:
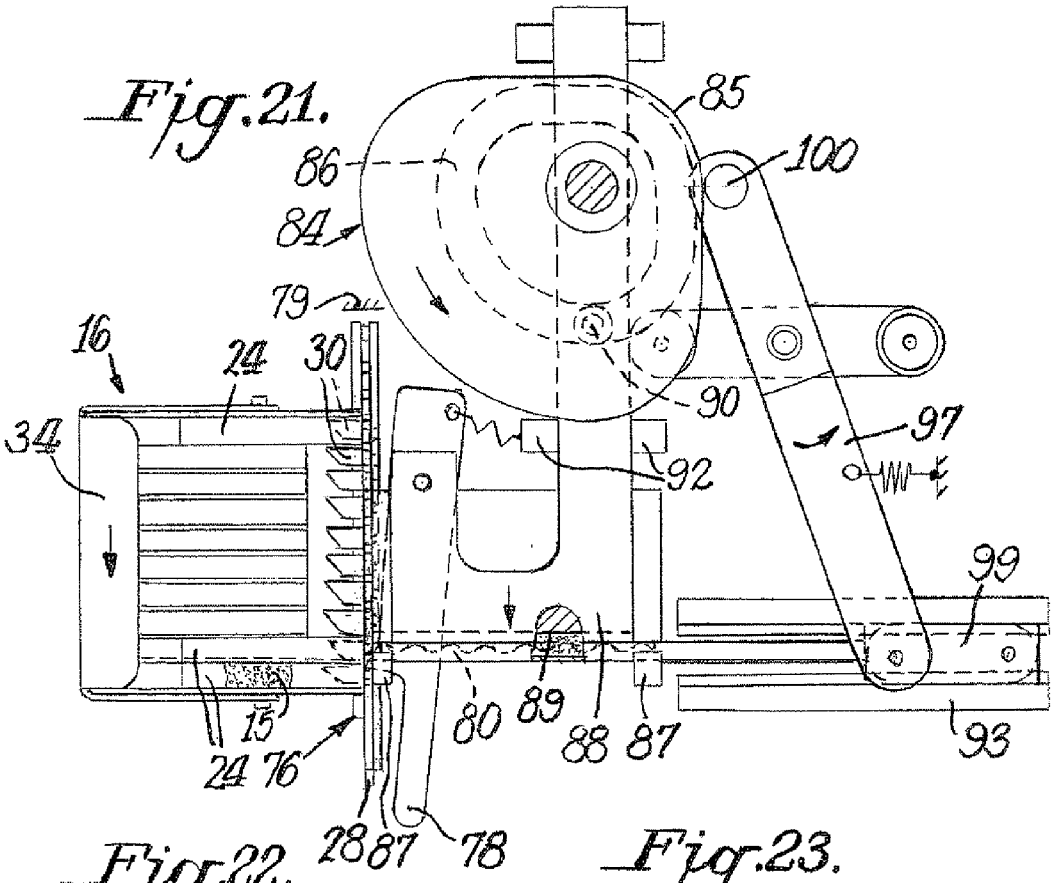
FIG. 21 is a top plan view showing the drive cam with an inner cam directing the compacting means proximate to the pushing means to compact tobacco for insertion into the cigarette tubes.

FIG. 21 shows the cam rotated 90° from FIG. 20. The cam 84 remains recessed in apparatus 10. The compactor 88 has advanced toward spoon 80 to compact tobacco 15 into the recess formed between spoon 80 and compactor 88. As the compactor advances, the indexer 78 engages with indexing pin 106 to advance whole cassette 16 forward such that the next cigarette tube 24 is aligned with spoon 80. The cam 84 continues to rotate to the position shown in FIG. 17 and the tobacco loading process begins for the second cigarette tube 24. This loading process may be programmed to be repeated as many times as necessary to form the desired number of cigarettes.

When the loading process is complete, the user may disengage indexer 78 by pressing it in a direction away from track 76 and remove the cassette 16 from the loading area 17 by sliding support plate 28 from track 76. Cassette 16 may then be slid from the track 76. The hinged lid 34 can be rotated and the cassette engaged with to the tobacco packing means 18. By engaging nozzles 30 with flattened tips 22, the cigarettes will be pushed off of nozzles 30 and tobacco 15 that is loose at the end of the cigarette 24 will be evenly compacted.

It should be understood that the above detailed description while indicating preferred embodiments of the invention are given by way of illustration only since various changes and modifications within the spirit and scope of the invention will become apparent to those skilled in the art from the detailed description.

For example, the step of loading cigarette tubes into the cassette, loading the cassette onto the indexer, loading the loose tobacco into the hopper, programming the computer, or any other preparatory step, could be performed in any order so long as all of the preparatory steps are performed prior to beginning the mechanical process of loading the tobacco into the cigarette tubes.

What is claimed is:

1. A cigarette making apparatus comprising:

a solenoid-assisted hopper for accepting loose tobacco and feeding the loose tobacco into a loading chamber;

a cigarette tube filling cassette with nozzles and a hinged lid for assisting in maintaining cigarette tubes in a predetermined alignment for loading tobacco;

a cigarette tube filling mechanism with a track for slidably accepting the cigarette tube filling cassette, a compactor for compacting tobacco in the loading chamber, and a pushing spoon for pushing compacted tobacco from loading chamber into cigarette tubes on the cigarette tube filling cassette;

an indexer for advancing the cassette to align each cigarette tube on the cigarette tube filling cassette with the tobacco pushing spoon;

a cigarette tube tobacco packing mechanism with guide pins for guiding the cassette in engagement with flatted tip pins that compress tobacco into cigarette tubes after tobacco has been inserted; and an electronic control for controlling the cigarette tube filling and packing apparatus.

2. The cigarette making apparatus of claim 1, wherein the cigarette tube filling mechanism is driven by a double action cam for driving a compactor that compacts tobacco in the loading chamber and for driving a pushing spoon for pushing tobacco from the loading chamber into the cigarette tubes.

3. The cigarette making apparatus of claim 1, wherein the hopper further comprises:

a hopper main body;

a shaker at least partially within the hopper main body that reciprocates in a vertical direction;

a door.

4. The cigarette making apparatus of claim 3, wherein the door is transparent, the door is slidably engaged with the hopper main body, and the door has ribs along the side facing toward the shaker.

5. The cigarette making apparatus of claim 3, wherein the shaker has fish-scale protrusions extending outwardly and downwardly from the shaker to assist in loading the tobacco into the loading chamber.

6. The cigarette making apparatus of claim 3, wherein the shaker is connected to a piston of a solenoid by a bracket, wherein the piston and solenoid are located outside the hopper main body, and the shaker and solenoid piston are connected by a bracket that extends through an opening in the hopper main body.

7. The cigarette making apparatus of claim 3, wherein the shaker has a tobacco loading guide for directing tobacco toward the loading chamber.

8. The cigarette making apparatus of claim 1, wherein the cigarette tube filling mechanism is driven by a motorized double action cam, the double action cam driving the compactor, the indexer, and the pushing spoon;

wherein the compactor has a cam roller engaged with an inner track of the double action cam so that the compactor reciprocates along compactor guides;

wherein the pushing spoon has a cam roller guided along the outer edge of the double action cam so that the pushing spoon reciprocates along a pushing spoon guide track; and wherein the indexer is pivotally connected to the compactor.

9. The cigarette making apparatus of claim 8, wherein the compactor cam roller is located 90° from the pushing spoon cam roller relative to the axis of the driveshaft.

10. A method for loading tobacco into cigarette tubes comprising:

dropping tobacco into a hopper with a computer controlled, solenoid activated, reciprocating shaker;

loading one or more cigarette tubes onto a cigarette tube cassette, the cassette comprising a hinged lid, rotatable to an open position to load the cigarette tubes and rotatable to a closed position to retain cigarette tubes in the cassette, and nozzles for maintaining the arrangement of cigarette tubes;

loading the cassette onto a track and engaging an indexer to index the cassette during the tobacco loading process;

programming a computer to control the frequency of shaker reciprocations per cigarette and the number of cigarettes to be formed;

running the program entered into the computer so that the hopper delivers tobacco to a loading mechanism, the loading mechanism compacts the tobacco and pushes the tobacco into the cigarette tube to form a cigarette, the indexer advances the cassette to align the next cigarette tube with the loading mechanism, and the process is repeated for a predetermined number of cigarettes; and removing the one or more cigarettes from the cassette.

11. The method of claim 10 wherein prior to removing the one or more cigarettes from the cassette, the cassette is disengaged from the indexer and unloaded from the track, the hinged lid is rotated into the open position, and the nozzles of the cassette are engaged with flattened tip pins to push the cigarettes off of the nozzles and evenly compact loose tobacco at the end of each cigarette.

12. The method of claim 10 wherein the loading mechanism compacts the tobacco with a compactor and pushes the tobacco into cigarette tubes with a pushing spoon.

13. The method of claim 12 wherein the compactor and pushing spoon are driven by a motorized double action cam that rotates about a driveshaft.

14. The method of claim 13 wherein the compactor has a cam roller engaged with an inner track of the double action cam so that the compactor reciprocates along compactor guides; and wherein the pushing spoon has a cam roller guided along the outer edge of the double action cam so that the pushing spoon reciprocates along a pushing spoon guide track.

15. The method of claim 13 wherein as the double action cam rotates about the driveshaft, the compactor first compacts the tobacco in the loading area to form compacted tobacco between the compactor and the pushing spoon, the pushing spoon then pushes the compacted tobacco into the cigarette tube, the pushing spoon then retracts from the cigarette tube, and the compactor recesses away from the pushing spoon to allow more tobacco to enter from the hopper.

16. The method of claim 15 wherein as the compactor compacts the tobacco for a first cigarette tube, the indexer engages a first indexing pin on the cassette to advance the cassette and align the first cigarette tube with the pushing spoon of the loading mechanism;

as the compactor recesses from the pushing spoon to accept more tobacco from the hopper, the indexer travels over a second indexing pin; and as the compactor compacts the tobacco for a second cigarette tube, the indexer engages a second indexing pin on the cassette to advance the cassette and align the second cigarette tube with the pushing spoon of the loading mechanism.

* * * * *